US007736248B2

(12) United States Patent
Eldridge

(10) Patent No.: US 7,736,248 B2
(45) Date of Patent: Jun. 15, 2010

(54) TRAINING APPARATUS FOR TRAINING PLAYERS INVOLVED IN SPORTS ACTIVITIES

(76) Inventor: Mark Eldridge, 816 State Hwy 11 C, Brasher Falls, NY (US) 13613

( * ) Notice: Subject to any disclaimer, the term of this patent is extended or adjusted under 35 U.S.C. 154(b) by 261 days.

(21) Appl. No.: 12/115,662

(22) Filed: May 6, 2008

(65) Prior Publication Data

US 2008/0280703 A1 Nov. 13, 2008

Related U.S. Application Data

(60) Provisional application No. 60/916,428, filed on May 7, 2007.

(51) Int. Cl.
*A63B 69/34* (2006.01)

(52) U.S. Cl. ..... 473/445; 473/443; 482/93; 73/379.04

(58) Field of Classification Search ..... 473/438, 473/441, 443, 445, 446, 444; 482/91, 92; 73/379.04; D21/788
See application file for complete search history.

(56) References Cited

U.S. PATENT DOCUMENTS 1,538,203 A * 5/1925 Moran ..... 473/443
1,909,461 A * 5/1933 Costa ..... 473/443
2,153,384 A * 4/1939 Mazza ..... 473/443
2,183,465 A * 12/1939 Noor ..... 73/379.04
2,255,711 A * 9/1941 Noor ..... 73/379.04
3,424,458 A * 1/1969 Hopps, Jr. ..... 473/443
3,637,210 A * 1/1972 Brantley ..... 473/443
4,186,922 A * 2/1980 Ketchum ..... 473/443
4,688,792 A * 8/1987 Rivkin ..... 482/90
6,824,504 B2 * 11/2004 Ott ..... 482/92
7,063,647 B2 * 6/2006 Harney et al. ..... 482/54
D601,218 S * 9/2009 Forrest, Sr. ..... D21/788

* cited by examiner

*Primary Examiner*—Gene Kim
*Assistant Examiner*—M Chambers
(74) *Attorney, Agent, or Firm*—Jay Schloff

(57) ABSTRACT

Disclosed is a training apparatus for training players involved in contact sports, such as football. The training apparatus includes a frame assembly, a first driving mechanism, a drifting mechanism, a second driving mechanism, and a dummy. The frame assembly is configured to support the first driving mechanism, the drifting mechanism, the second driving mechanism, and the dummy thereon. The first driving mechanism is configured to move the dummy in a longitudinal direction, the second driving mechanism is configured to move the dummy in a transverse direction, and the drifting mechanism is configured to move the dummy along a vertical axis of the frame assembly. Further disclosed is a training system including a training apparatus and a controlling module. The controlling module is operatively coupled to the training apparatus for controlling the longitudinal direction movement, the transverse direction movement, and the vertical axis movement of the dummy.

21 Claims, 9 Drawing Sheets

TRAINING APPARATUS FOR TRAINING PLAYERS INVOLVED IN SPORTS ACTIVITIES

CROSS-REFERENCE TO RELATED APPLICATIONS

The present invention claims priority under 35 United States Code, Section 119 on the U.S. Provisional Patent Application numbered 60/916,428 filed on May 7, 2007, the disclosure of which is incorporated by reference.

FIELD OF THE INVENTION

The present invention relates generally to athletic training equipment, and, more specifically, to a training apparatus for training players involved in contact sports, such as football, for evaluating and improving the players' techniques.

BACKGROUND OF THE INVENTION

A contact sport is a sport that includes significant physical contact between players participating in the sport. Some of the popular contact sports include rugby football, American football, ice hockey, lacrosse, amateur wrestling, and the like. American football, generally known as football in the United States and Canada, is a competitive team sport that involves both physical toughness of the players involved and a complex level of strategy between the players. Derived from the English game of rugby, American football was started in 1879. Since then, American football has become a multi-billion dollar business in its professional form.

Football is played between two teams of players, wherein the object of each team is to advance a ball into opposing team's area. The team which is advancing the ball may be referred to as an "offensive team" and the team which is preventing the advancement of the ball into their area may be referred to as "defensive team". To prevent the offensive team from advancing the ball, the defensive team may tackle a ball-carrying player of the offensive team by knocking the player to ground or out of bounds of the field of play. Accordingly, players of defensive team may use some technique of physical contact to knock the ball-carrying player of the offensive team to the ground. The game of football is both physically and intellectually demanding, and requires the players to possess excellent athletic skills, physical strength, and quick thinking.

Football players of the offensive team and the defensive team are involved in various playing techniques, such as tackling, blocking and drilling. These playing techniques require different training strategies and different movement pattern of the football players. For developing and improving athletic skills, physical strength and playing techniques of the football players, their coaches generally employ conventional football training devices and systems. The conventional football training devices are adapted to simulate conditions of an actual football game for enabling the football players to practice their techniques without requiring them to encounter real football players. A blocking sled is one of the conventional football training devices used for training football players to practice various playing techniques, such as blocking. A conventional blocking sled preferably includes a dummy attached to supports, such as crossbeams for enabling the football players to practice blocking techniques. However, the dummy of the blocking sled is generally stationary in the nature or capable of being moved in one direction only.

Most conventional football training devices, such as the aforementioned devices, do not simulate movement patterns of real football players for training the football players.

Further, the coaches of the football players may be required to accurately evaluate the athletic skills, physical strength and playing techniques of their players. In such instance, the conventional football training devices are not adapted to provide an accurate assessment of the athletic skills, the physical strength and the playing techniques of the players. Accordingly, the coaches are generally unable to strategize training sessions for the players to locate and up bring the shortcomings in the techniques of their players.

Based on the foregoing, there exists a need for a training apparatus that is capable of simulating actual game conditions for training players. More specifically, there persists a need for a training apparatus which is adapted to simulate various movement patterns of real players involved in a sport activity, such as football. Further, there exists a need for a training system that is capable of measuring and analyzing athletic skills, physical strength and playing techniques of the players in an easy and reliable manner.

SUMMARY OF THE INVENTION

In view of the foregoing disadvantages inherent in the prior art, the general purpose of the present invention is to provide a training apparatus configured to include all advantages of the prior art, and to overcome the drawbacks inherent therein.

Accordingly, an object of the present invention is to provide a training apparatus that is capable of simulating real time conditions of an actual sport for training players. More specifically, the training apparatus is adapted to simulate various movement patterns of real players involved in the sport while training the players.

Another object of the present invention is to provide a training system that is capable of measuring and analyzing athletic skills, physical strength and playing techniques of players being trained on the training system in an easy and reliable manner.

To achieve the above objects of the present invention, in an aspect, the present invention provides a training apparatus for training players involved in sports activities, such as football. The training apparatus includes a frame assembly, a first driving mechanism, a drifting mechanism, a second driving mechanism, and a dummy. The frame assembly includes a pair of first frame members, a pair of supporting frame members and a second frame member. The pair of first frame members is spaced apart and extends longitudinally opposite to each other. The pair of supporting frame members is spaced apart and extends longitudinally opposite to each other. The pair of supporting frame members is coupled to the pair of first frame members for configuring a space therebetween. The second frame member is operatively coupled to the pair of first frame members and extends therebetween. The first driving mechanism is adapted to configure an operative coupling between the pair of first frame members and the second frame member. The drifting mechanism is movably secured to the second frame member. The drifting mechanism is adapted to move longitudinally along the second frame member. The second driving mechanism is adapted to support the drifting mechanism thereon and movably secure the drifting mechanism to the second frame member. The dummy is operatively coupled to the drifting mechanism. Specifically, the dummy is movably secured to the second frame member through the drifting mechanism. The first driving mechanism is capable of moving the second frame member longitudinally along the pair of first frame members and thereby enabling the dummy to move in a longitudinal direction of the frame assembly. The second driving mechanism is capable of moving the drifting mechanism longitudinally along the second frame member and thereby enabling the dummy to move in a transverse direction of the frame assembly.

In another aspect, the present invention provides a training system. The training system includes a training apparatus and a controlling module. The training apparatus includes a frame assembly, a first driving mechanism, a drifting mechanism, a second driving mechanism, and a dummy. The frame assembly includes a pair of first frame members, a pair of supporting frame members and a second frame member. The pair of first frame members is spaced apart and extends longitudinally opposite to each other. The pair of supporting frame members is spaced apart and extends longitudinally opposite to each other. The pair of supporting frame members is coupled to the pair of first frame members for configuring a space therebetween. The second frame member is operatively coupled to the pair of first frame members and extends therebetween. The first driving mechanism is adapted to configure an operative coupling between the pair of first frame members and the second frame member. The drifting mechanism is movably secured to the second frame member. The drifting mechanism is adapted to move longitudinally along the second frame member. The second driving mechanism adapted to support the drifting mechanism thereon and movably secure the drifting mechanism to the second frame member. The dummy is operatively coupled to the drifting mechanism. Specifically, the dummy is movably secured to the second frame member through the drifting mechanism. The controlling module is communicably coupled to the training apparatus. The first driving mechanism is capable of moving the second frame member longitudinally along the pair of first frame members and thereby enabling the dummy to move in a longitudinal direction of the frame assembly. The second driving mechanism is capable of moving the drifting mechanism longitudinally along the second frame member and thereby enabling the dummy to move in a transverse direction of the frame assembly. The drifting mechanism is configured to drive the dummy along a vertical axis thereof and thereby enabling the dummy to move along a vertical axis of the frame assembly. The controlling module is capable of controlling the longitudinal direction movement, the transverse direction movement, and the vertical axis movement of the dummy.

These together with the other aspects of the present invention, along with the various feature of novelty that characterized the present invention, are pointed out with particularity in the claims annexed hereto and form a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting.

The term "first", "second" and the like, herein do not denote any order, elevation or importance, but rather are used to distinguish one element over another, and the terms "a" and "an" herein do not denote a limitation of quantity, but rather denote the presence of at least one of the referenced item.

The present invention provides a training apparatus for training a player involved in contact sport, such as American football (hereinafter referred to as 'football'). The training apparatus includes a dummy that is capable of being moved in various directions at one particular time for simulating actions of real time players for representing actual game conditions of the contact sport. The training apparatus may be utilized for training players to enhance their physical and intellectual skills in tackling real game conditions. The present invention also provides a training system capable of easily and reliably evaluating and analyzing athletic skills, physical strength and playing techniques of players being trained on the training system.

Figure 1:
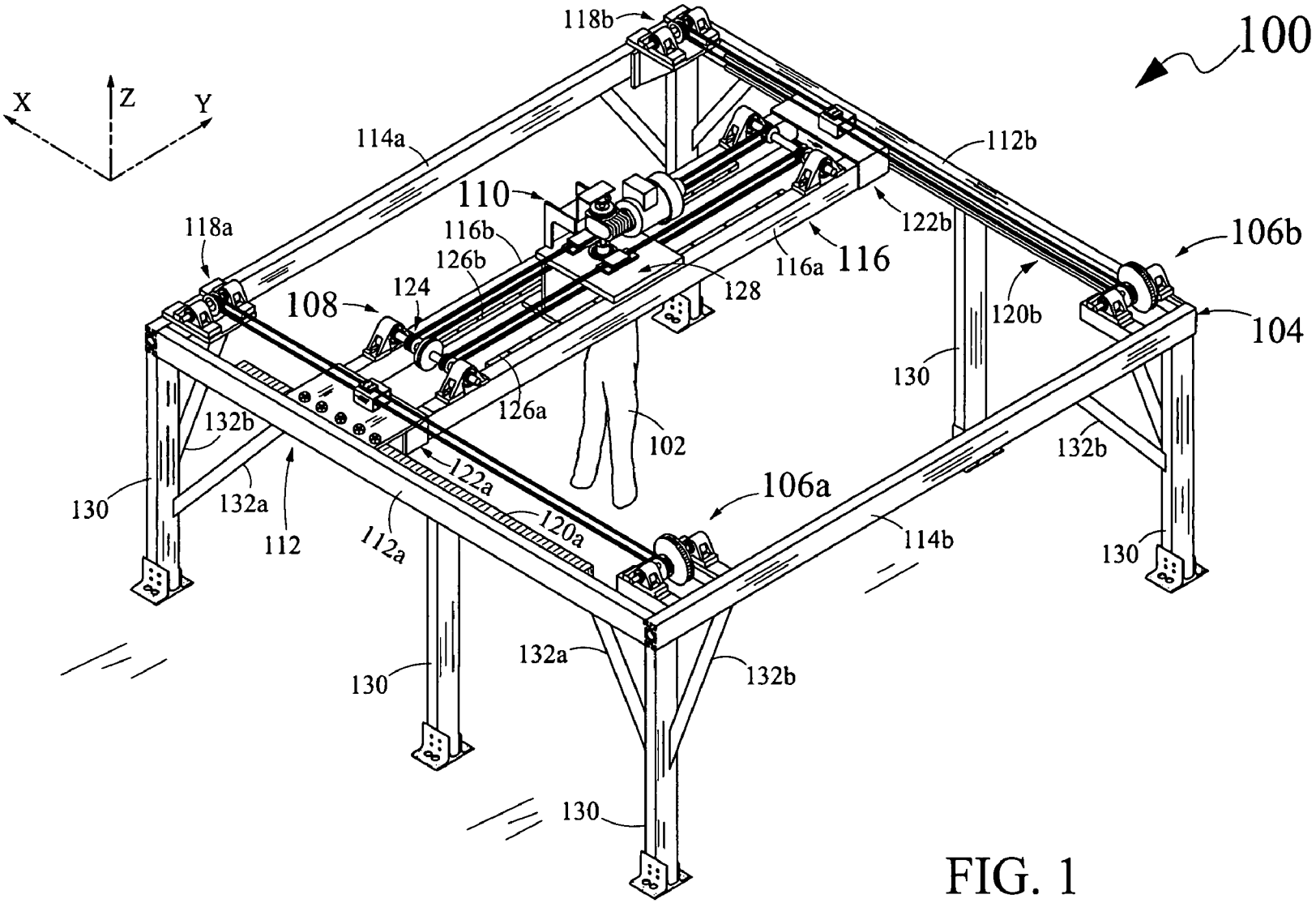
FIG. 1 illustrates a perspective view of a training apparatus, in accordance with an exemplary embodiment of the present invention.

Referring to FIG. 1, illustrated is a perspective view of the training apparatus, such as a training apparatus 100, in accordance with an exemplary embodiment of the present invention. The training apparatus 100 is capable of moving a dummy 102 in various directions at one particular time. More specifically, the dummy 102 may be moved in a various directions for simulating real time movements of actual players in an actual contact game, for training players. For example, the training apparatus 100 may be utilized to simulate actual conditions of a football game by enabling the dummy 102 to move in various directions to train football players for different player positions, such as an offensive or a defensive lineman position. The training apparatus 100 as set forth herein has been explained with respect to training football players. It will be however, evident to a person skilled in the art that the training apparatus may be utilized for training players on a variety of contact sports that involve interaction between players of opposing teams.

The training apparatus 100 comprises a frame assembly 104, a first driving mechanism having a first driving portion 106*a* and a second driving portion 106*b* (hereinafter, collectively referred to as "first driving mechanism 106"), a second driving mechanism 108, and a drifting mechanism 110. The frame assembly 104 includes a pair of first frame members, such as a first frame member 112*a* and a first frame member 112*b* (hereinafter, collectively referred to as "pair of first frame members 112"), a pair of supporting frame members, such as a supporting frame member 114*a* and a supporting frame member 114*b* (hereinafter, collectively referred to as "pair of supporting frame members 114") coupled to the pair of first frame members 112, and a second frame member 116. The pair of first frame members 112 extends longitudinally opposite to each other and is spaced apart by a predetermined distance. The predetermined distance may be evaluated depending upon a required size of the frame assembly 104. The pair of supporting frame members 114 extend longitudinally opposite to each other between the opposite end portions of the pair of first frame members 112 to configure a space therebetween. More specifically, as shown in FIG. 1, the supporting frame member 114*a* extends between one end portion of the first frame members 112*a* and 112*b* and the supporting frame member 114*b* extends between another end portion of the first frame members 112*a* and 112*b*. Without limiting the scope of the present invention, in an embodiment, the pair of first frame members 112 and the pair of supporting frame members 114 configure a substantially rectangular space therebetween.

The pair of supporting frame members 114 may be coupled to the pair of first frame members 112 by a coupling means, such as screws, rivets, and the like. However, it will be evident to a person skilled in the art that the pair of supporting frame members 114 may be coupled to the pair of first frame members 112 by utilizing conventional coupling processes, such as welding, interlocking, and the like. The pair of supporting frame members 114 coupled to the pair of first frame members 112 for providing rigidity to the frame assembly 104. Further, in an embodiment of the present invention, the pair of supporting frame members 114 may have a structural configuration similar to the structural configuration of the pair of first frame members 112.

The frame assembly 104 further includes the second frame member 116 extending between the pair of first frame members 112. More specifically, the second frame member 116 extends between the first frame members 112*a* and 112*b*. In an embodiment of the present invention, the second frame member 116 includes a pair of second frame structures 116*a* and 116*b*. The pair of second frame structures 116*a* and 116*b* extend longitudinally opposite to each other between the first frame members 112*a* and 112*b*, as shown in FIG. 1. Moreover, the second frame member 116 is operatively coupled to the pair of first frame members 112.

The operative coupling between the pair of first frame members 112 and the second frame member 116 is enabled by the first driving mechanism 106. The first driving mechanism 106 includes a pair of first pulley assemblies, such as a first pulley assembly 118*a* and a first pulley assembly 118*b*, a pair of first frame rail assemblies, such as a first frame rail assembly 120*a* and a first frame rail assembly 120*b*, and a pair of plate assemblies, such as a plate assembly 122*a* and a plate assembly 122*b*. More specifically, the first driving portion 106*a* of the first driving mechanism 106 includes the first pulley assembly 118*a*, the first frame rail assembly 120*a* and the plate assembly 122*a* adapted to configure the operative coupling between one end portion of the second frame member 116 and the first frame member 112*a*. The second driving portion 106*b* of the first driving mechanism 106 includes the first pulley assembly 118*b*, the first frame rail assembly 120*b* and the plate assembly 122*b* adapted to configure the operative coupling between another end portion of the second frame member 116 and the first frame member 112*b*. More particularly, the first driving mechanism 106 is adapted to enable the second frame member 116 to move longitudinally along the first frame members 112*a* and 112*b* in a longitudinal direction (shown as 'X' in FIG. 1) of the frame assembly 104. The operative coupling between the first frame members 112*a* and 112*b* and the second frame member 116 will be described in detail in conjunction with FIG. 2.

Moreover, the drifting mechanism 110 is movably secured to the second frame member 116. More specifically, the drifting mechanism 110 is supported on the second driving mechanism 108. In an embodiment of the present invention, the second driving mechanism 108 is configured between the pair of second frame structures 116*a* and 116*b*, thereby movably securing the drifting mechanism 110 to the pair of second frame structures 116*a* and 116*b*. The second driving mechanism 108 includes a second pulley assembly 124, a pair of second frame rail assemblies 126*a* and 126*b*, and a second frame plate assembly 128. More specifically, the pair of second frame rail assemblies 126*a* and 126*b* are coupled to the pair of second frame structures 116*a* and 116*b* respectively, and the second frame plate assembly 128 is movably coupled to the pair of second frame rail assemblies 126*a* and 126*b*. The second driving mechanism 108 enables the drifting mechanism 110 to move longitudinally along the second frame member 116 in a transverse direction (shown as 'Y' in FIG. 1) of the frame assembly 104. The operative coupling between the second driving mechanism 108 and the second frame member 116 will be explained in detail in conjunction with FIG. 4.

The dummy 102 is operatively coupled to the drifting mechanism 110 such that the dummy 102 extends downwardly with respect to the frame assembly 104. More specifically, the dummy 102 is operatively coupled to the drifting mechanism 110 in a manner, such that the dummy 102 is movably secured to the second frame member 116. In an embodiment of the present invention, the operative coupling of the drifting mechanism 110 and the dummy 102 is in a manner, such that the dummy 102 is capable of being moved in a multitude of directions about a vertical axis 'Z' (as shown in FIG. 1) of the frame assembly 104. For example, the dummy 102 may be adapted to have a spinning motion about the vertical axis 'Z', a pivoting motion about the vertical axis 'Z', and a rectilinear motion along the vertical axis 'Z'. The operative coupling between the dummy 102 and the drifting mechanism 110 will be described in detail in conjunction with FIGS. 7A through 7C.

Further, the dummy 102 may be selectively moved in the longitudinal direction 'X' and the transversal direction 'Y' of the frame assembly 104 with the help of the first driving mechanism 106 and the second driving mechanism 108, respectively. More specifically, the first driving mechanism 106 may be utilized to move the second frame member 116 along the pair of first frame members 112. Accordingly, the dummy 102, movably secured to the second frame member 116, may be moved in the longitudinal direction 'X' of the frame assembly 104. Moreover, the second driving mechanism 108 may be utilized to move the drifting mechanism 110 along the second frame member 116, thereby moving the dummy 102 coupled to the drifting mechanism 110, in the transverse direction 'Y' of the frame assembly 104.

Accordingly, the dummy 102 is capable of being moved in the longitudinal direction 'X', in the transverse direction 'Y' and about the vertical axis 'Z' of the frame assembly 104, at a particular instance. The various movement patterns of the dummy 102 with respect to the frame assembly 104 enable simulation of actual game conditions for training players without requiring real players to compete against each other.

Further, the frame assembly 104 includes a plurality of support members 130 coupled to the frame assembly 104 for providing support thereto. In one embodiment of the present invention, the plurality of support members 130 extends downwardly from the frame assembly 104. The plurality of support members 130 enable the frame assembly 104 to be supported at a predetermined height from a surface, such as a ground surface. The plurality of support members 130 may be coupled to the frame assembly 104 by utilizing conventional coupling means, such as screws, rivets, and the like. As shown in FIG. 1, the plurality of support members 130 are coupled to the pair of first frame members 112 and joints between the pair of first frame members 112 and pair of supporting frame members 114. However, the plurality of support members 130 may be coupled to any other convenient place on the frame assembly 104 and also according to the requirement of users.

Additionally, without limiting the scope of the present invention, the frame assembly 104 further includes a plurality of bracing members 132 extending between the frame assembly 104 and the plurality of support members 130. More specifically, bracing members 132*a* extend between the pair of first frame members 112 and corresponding support members 130 and the bracing members 132*b* extend between the pair of supporting frame members 114 and corresponding support members 130, as shown in FIG. 1. The bracing members 132*a* and bracing members 132*b* are hereafter collectively referred to as plurality of bracing members 132. The plurality of bracing members 132 enable the plurality of support members 130 to be securely coupled to the pair of first frame members 112 and the pair of supporting frame members 114, thereby providing sufficient rigidity to the frame assembly 104. It will be obvious to a person skilled in the art that the plurality of bracing members 132 may be coupled to the frame assembly 104 in any other manner that provides sufficient rigidity to the frame assembly 104.

Figure 2:
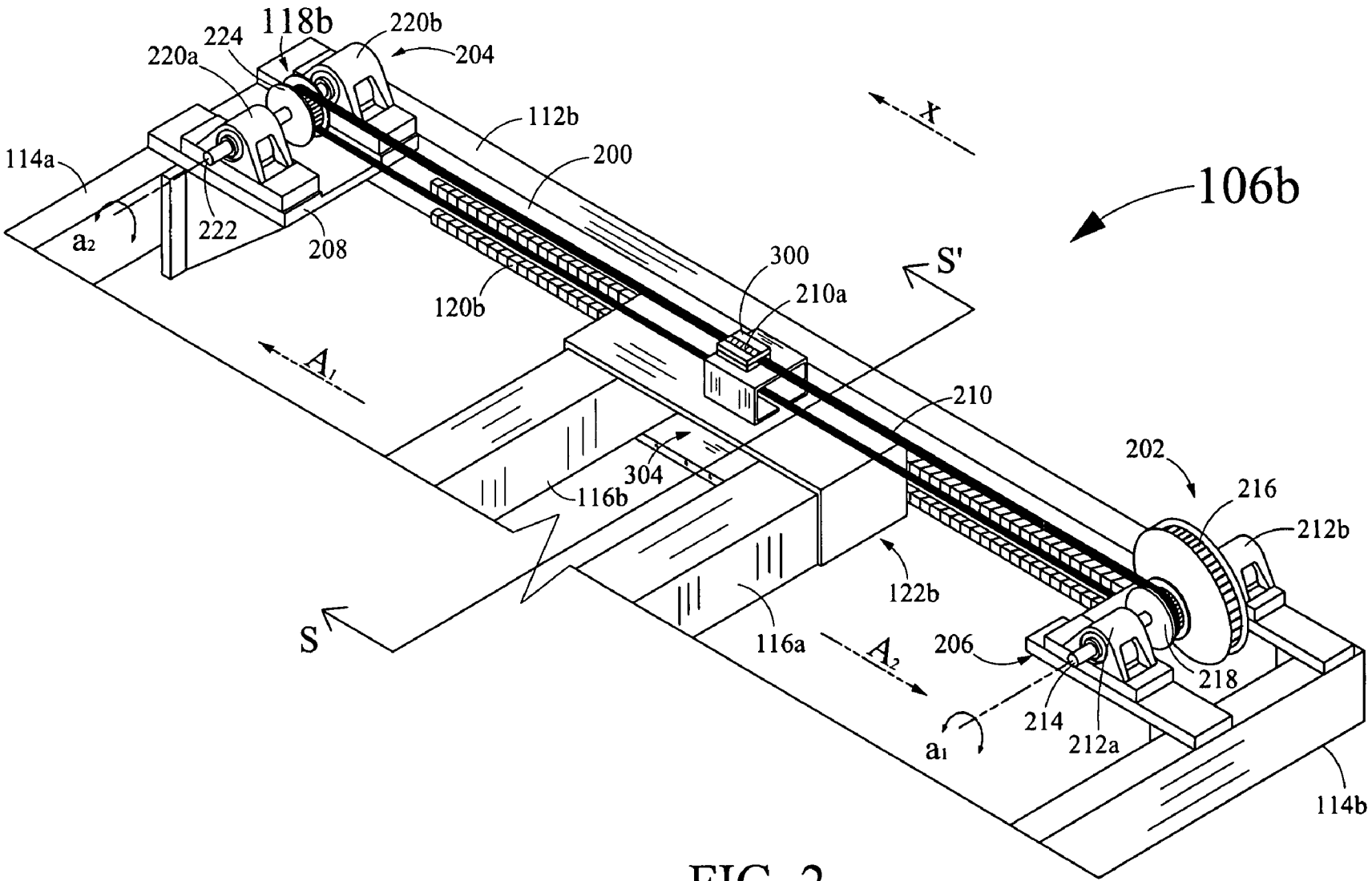
FIG. 2 illustrates a partial perspective view of the training apparatus for depicting a second driving portion of a first driving mechanism, in accordance with an exemplary embodiment of the present invention.

Referring to FIG. 2, illustrated is a partial perspective view of the training apparatus 100 for depicting the second driving portion 106*b* of the first driving mechanism 106, in accordance with an exemplary embodiment of the present invention. More specifically, FIG. 2 illustrates the operative coupling between the second frame member 116 and the pair of first frame members 112. The second driving portion 106*b* of the first driving mechanism 106 configures the operative coupling between an end portion of the second frame member 116 and the first frame member 112*b*. The second driving portion 106*b* includes the first pulley assembly 118*b*, the first frame rail assembly 120*b* and the plate assembly 122*b*. The first frame rail assembly 120*b* is coupled at an inner side wall 200 of the first frame member 112*b* such that the first frame rail assembly 120*b* extends along the first frame member 112*b* in the longitudinal direction 'X' of the frame assembly 104. The plate assembly 122*b* is coupled to an end portion of the second frame member 116. More specifically, the plate assembly 122*b* is coupled to an end portion of the pair of second frame structures 116*a* and 116*b*.

The plate assembly 122*b* is further movably coupled to the first frame rail assembly 120*b* for enabling the plate assembly 122*b* to move along the first frame rail assembly 120*b* in the longitudinal direction 'X' of the frame assembly 104. More particularly, the first frame rail assembly 120*b* is configured to have a longitudinal channel (not shown) adapted to movably couple the plate assembly 122*b* thereto. Accordingly, the second frame member 116 is operatively coupled to the first frame member 112*b*. The coupling between the first frame rail assembly 120*b* and the plate assembly 122*b* will be further explained in conjunction with FIGS. 3A and 3B.

The movement of the plate assembly 122*b* along the first frame rail assembly 120*b* is enabled by the first pulley assembly 118*b*. The first pulley assembly 118*b* extends along the first frame member 112*b*. More specifically, the first pulley assembly 118*b* includes two pulley arrangements 202 and 204 configured at opposite end portions of the pair of supporting frame members 114, as shown in FIG. 2. The pulley arrangements 202 is supported on a support structure 206 coupled to the end portion of the supporting frame member 114*b*. Similarly, the pulley arrangements 204 is supported on a support structure 208 coupled to the end portion of the supporting frame member 114*a*. The pulley arrangements 202 and 204 are operatively coupled to each other with the help of a belt 210 extending therebetween.

The pulley arrangement 202 includes bearing housings 212*a* and 212*b* supported on the support structure 206, and a rotating shaft 214. The rotating shaft 214 extends between the bearing housings 212*a* and 212*b* and is movably coupled thereto to rotate about an axis $a_1$ thereof. The pulley arrangement 202 further includes a major pulley 216 and a minor pulley 218 received on the rotating shaft 214. More specifically, the major pulley 216 and the minor pulley 218 are coaxially received on the rotating shaft 214. Similarly, the pulley arrangement 204 includes bearing housings 220*a* and 220*b* supported on the support structure 208, and a rotating shaft 222 extending between the bearing housings 220*a* and 220*b* and is movably coupled thereto to rotate about an axis $a_2$ thereof. The pulley arrangement 204 further includes a minor pulley 224 received on the rotating shaft 222.

The pulley arrangements 202 and 204 are operatively coupled to each other such that the belt 210 extends between the minor pulley 218 and the minor pulley 224. In an embodiment of the present invention, the minor pulleys 218 and 224 may include a grooved peripheral surface adapted to receive the belt 210 thereon. The grooved peripheral surface is adapted to provide sufficient friction to avoid slippage of the belt 210 therefrom. Moreover, the major pulley 216 is adapted to be rotated about the axis $a_1$ of the rotating shaft 214. The major pulley 216 may be rotated by a separate belt-motor assembly (not shown).

Moreover, a portion 210*a* (shown with dotted lines in FIG. 2) of the belt 210 is engaged to an attachment block 300 of the plate assembly 122*b*, thereby enabling the plate assembly 122*b* to be firmly coupled to the belt 210. The attachment block 300 and the coupling between the portion 210*a* of the belt 210 and the plate assembly 122*b* will be explained in conjunction with FIGS. 3A and 3B.

In operation, the major pulley 216 is driven by the belt-motor assembly. With the rotation of the major pulley 216, the rotating shaft 214 and the minor pulley 218 connected thereto begins to rotate about the axis '$a_1$' of the rotating shaft 214. The belt 210 received on the minor pulley 218 transfers the rotary motion thereof to the minor pulley 224, which in turn rotates about the axis '$a_2$', thereby enabling the belt 210 to move rectilinearly between the minor pulleys 218 and 224.

With the movement of the belt 210, the plate assembly 122*b*, coupled to the portion 210*a* of the belt 210, begins to move along the first frame rail assembly 120*b* in the longitudinal direction 'X' of the frame assembly 104. Accordingly, the second frame member 116 coupled to the plate assembly 122*b* is capable of being moved along the first frame rail assembly 120*b*. The major pulley 216 may be adapted to be rotated in a clockwise and an anticlockwise direction such that the second frame member 116 may be moved in a forward direction (shown by an arrow '$A_1$') and a backward direction (shown by an arrow 'A2').

Referring back to FIG. 1, the structural configuration and functionality of the first driving portion 106*a* of the first driving mechanism 106 is similar to the structural configuration and functionality of the second driving portion 106*b*, as described herein. Accordingly, a detailed explanation thereof has been avoided for sake of brevity. The first driving portion 106*a* is disposed on another end portion of the second frame member 116 to configure the operative coupling between the end portion of the second frame member 116 and the first frame member 112*a*. Accordingly, the second frame member 116 is adapted to move longitudinally along the first frame member 112*a* in the longitudinal direction 'X' of the frame assembly 104.

The operative coupling between the end portions of the second frame member 116 and the pair of first frame members 112 configured by the first driving portion 106*a* and the second driving portion 106*b* enables the second frame member 116 to move longitudinally along the pair of first frame members 112 in the longitudinal direction 'X' of the frame assembly 104. Accordingly, the dummy 102 movably secured to the second frame member 116 through the drifting mechanism 110 may be moved in the longitudinal direction 'X' of the frame assembly 104.

Figure 3A:
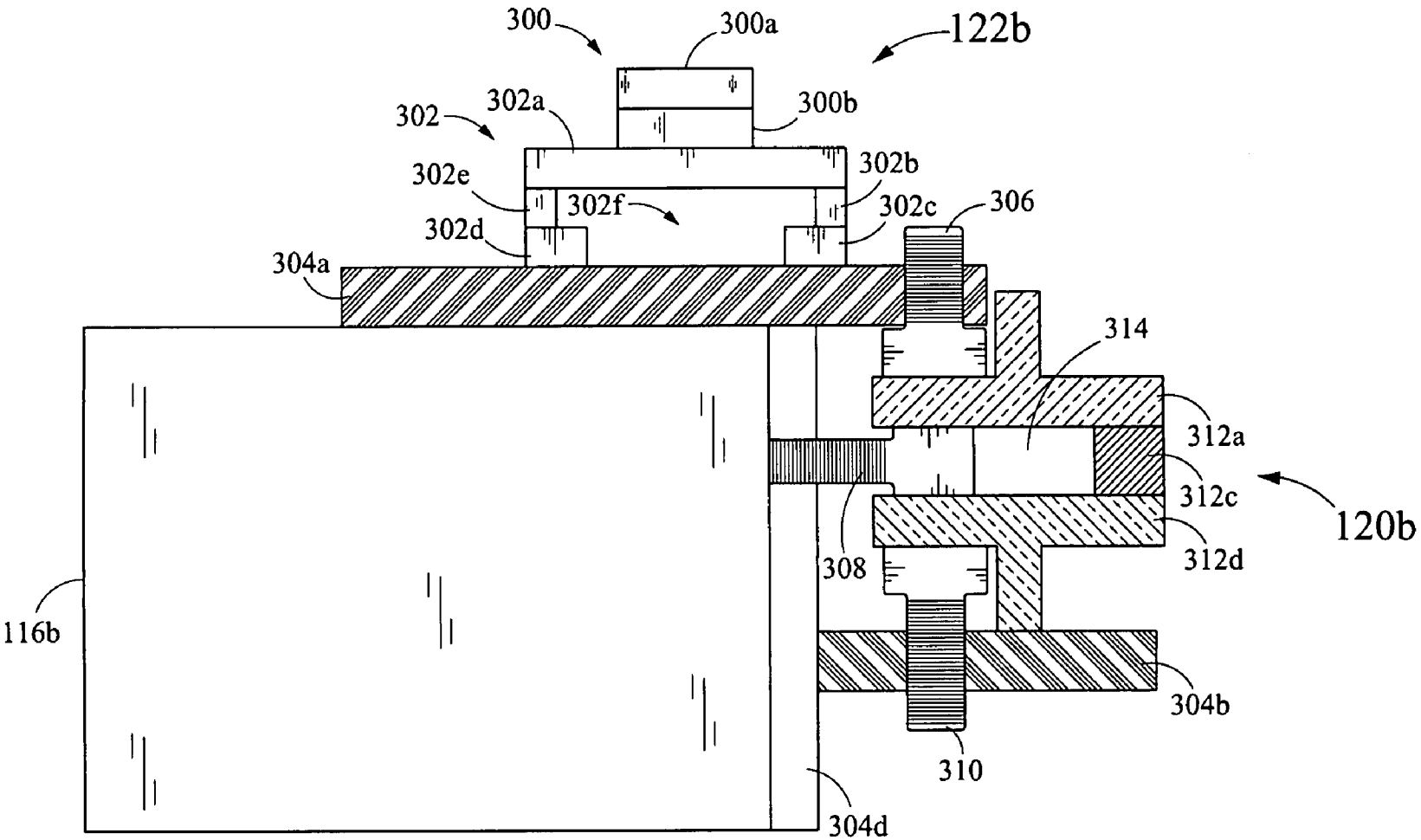
FIG. 3A illustrates a cross sectional view of the second driving portion of the first driving mechanism of FIG. 2 along a sectional line S-S', in accordance with an exemplary embodiment of the present invention.
Figure 3B:
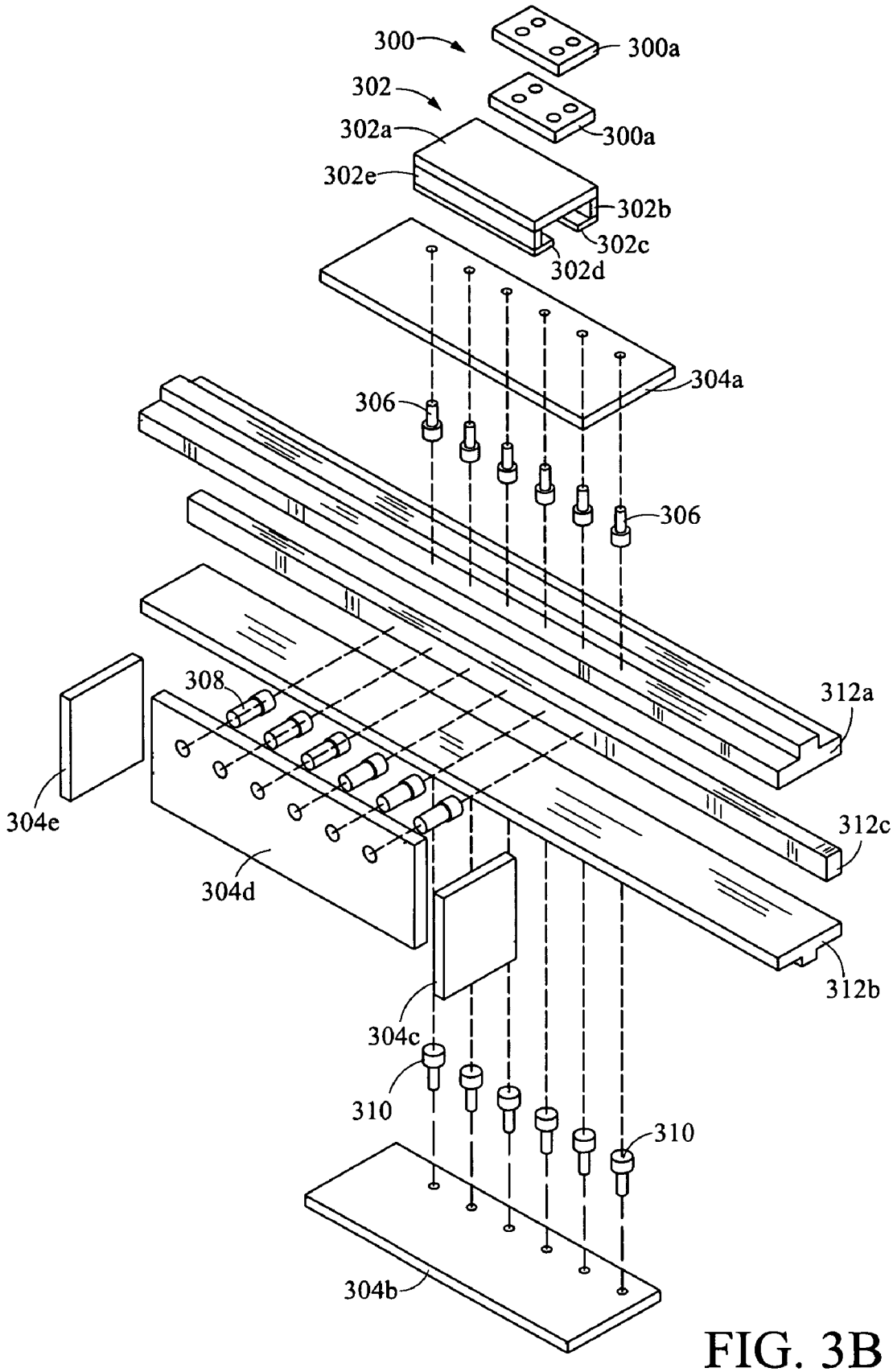
FIG. 3B illustrates an exploded perspective view of a first frame rail assembly and a plate assembly of the first driving mechanism, in accordance with an exemplary embodiment of the present invention.

Referring now to FIG. 3A and FIG. 3B, the operative coupling between the first frame rail assembly 120*b* and the plate assembly 122*b* is illustrated. Referring to FIG. 3A, illustrated is a cross sectional view of the second driving portion 106*b* of the first driving mechanism 106 of FIG. 2 along a sectional line S-S', in accordance with an exemplary embodiment of the present invention. More specifically, FIG. 3A illustrates the operative coupling between the first frame rail assembly 120*b* and the plate assembly 122*b*. Further, FIG. 3B illustrates an exploded perspective view of the first frame rail assembly 120*b* and the plate assembly 122*b*.

As shown in FIGS. 3A and 3B, the plate assembly 122*b* includes the attachment block 300, a bridge structure 302 and a housing 304. The attachment block 300 includes metal plates 300*a* and 300*b* disposed one over the other in a stacked fashion. The metal plates 300*a* and 300*b* are removably coupled to each other in a manner such that they are adapted to receive the portion 210*a* of the belt 210 therebetween, as shown in FIG. 2. The attachment of the metal plates 300*a* and 300*b* with the belt 210 enables the movement of plate assembly 122*b*, when the belt 210 is moved between the pulley arrangements 202 and the pulley arrangements 204. Further, the attachment block 300 is coupled to a top surface of the bridge structure 302. In an embodiment of the present invention, the bridge structure 302 may include a plurality of plates, such as plates 302*a* to 302*e*. The bridge structure 302 is coupled to the housing 304. More specifically, the bridge structure 302 is coupled to a top plate 304*a* of the housing 304 such that a recess 302*f* is configured therebetween. The recess 302*f* is adapted to enable the belt 210 to extend between the minor pulley 218 and the minor pulley 224 to pass therethrough, as shown in FIG. 2. The attachment block 300 along with the bridge structure 302 configures the coupling between the belt 210 and the plate assembly 122*b*.

In an embodiment of the present invention, the housing 304 includes the top plate 304*a*, a bottom plate 304*b* and side plates 304*c*, 304*d* and 304*e*, see FIG. 3B. The side plates 304*c*, 304*d* and 304*e* are coupled to form side walls of the housing 304. The top plate 304*a* is horizontally secured on top of the side walls of the housing 304 and the bottom plate 304*b* horizontally extends from the side plate 304*d*, as shown in FIG. 3A. The top plate 304*a*, the bottom plate 304*b*, and the side plates 304*c*, 304*d* and 304*e* configure a hollow enclosure therebetween. The hollow enclosure is adapted to receive the end portion of the pair of second frame structures 116*a* and 116*b* of the second frame member 116 therein for coupling the plate assembly 122*b* thereto. Further, as explained earlier the plate assembly 122*b* is movably coupled to the first frame rail assembly 120*b*. More specifically, the housing 304 of the plate assembly 122*b* is movably coupled to the first frame rail assembly 120*b*.

The first frame rail assembly 120*b* includes first frame rail members 312*a* and 312*b*. In an embodiment of the present invention, the first frame rail members 312*a* and 312*b* may be longitudinal T-shaped bars. The first frame rail members 312*a* and 312*b* may be coupled together by a horizontal bar 312*c* to configure a longitudinal channel structure 314 therebetween.

The movable coupling between the housing 304 and the first frame rail assembly 120*b* is enabled by a plurality of metal plugs, such as metal plugs 306, metal plugs 308 and metal plugs 310. The plurality of metal plugs is configured to have cylindrical head portions, which are adapted to be received on the first frame rail assemblies 120*a* and 120*b*. The metal plugs 306 are configured at an edge portion of the top plate 304*a* and extend downwardly therefrom, as shown in FIGS. 3A and 3B, such that the cylindrical head portions thereof are received on the first frame rail member 312*a*. Further, the metal plugs 308 are configured at an edge portion of the side plate 304*d* and extend outwardly therefrom, as shown in FIGS. 3A and 3B, such that the cylindrical head portions thereof are received in the longitudinal channel structure 314 of the first frame rail assembly 120*b*. Furthermore, the metal plugs 310 are configured at an edge portion of the bottom plate 304*b* and extend upwardly therefrom, as shown in FIGS. 3A and 3B, such that the cylindrical head portions thereof are received on the first frame rail member 312*b*. The plurality of metal plugs are configured on the top plate 304*a*, the bottom plate 304*b* and the side plate 304*d* in a manner such that the plurality of metal plugs are free to rotate about an axis thereof.

In operation, upon movement of the belt 210 rectilinearly between the minor pulleys 218 and 224, plate assembly 122*b* is urged to move along the first frame rail assembly 120*b*. As a result, the plurality of metal plugs is enabled to rotate about their axis at respective portions of the first frame rail assembly 120*b* whereupon the plurality of metal plugs is received. The rotational movement of the plurality of metal plugs smoothens the movement of the plate assembly 122*b* along the first frame rail assembly 120*b*.

Figure 4:
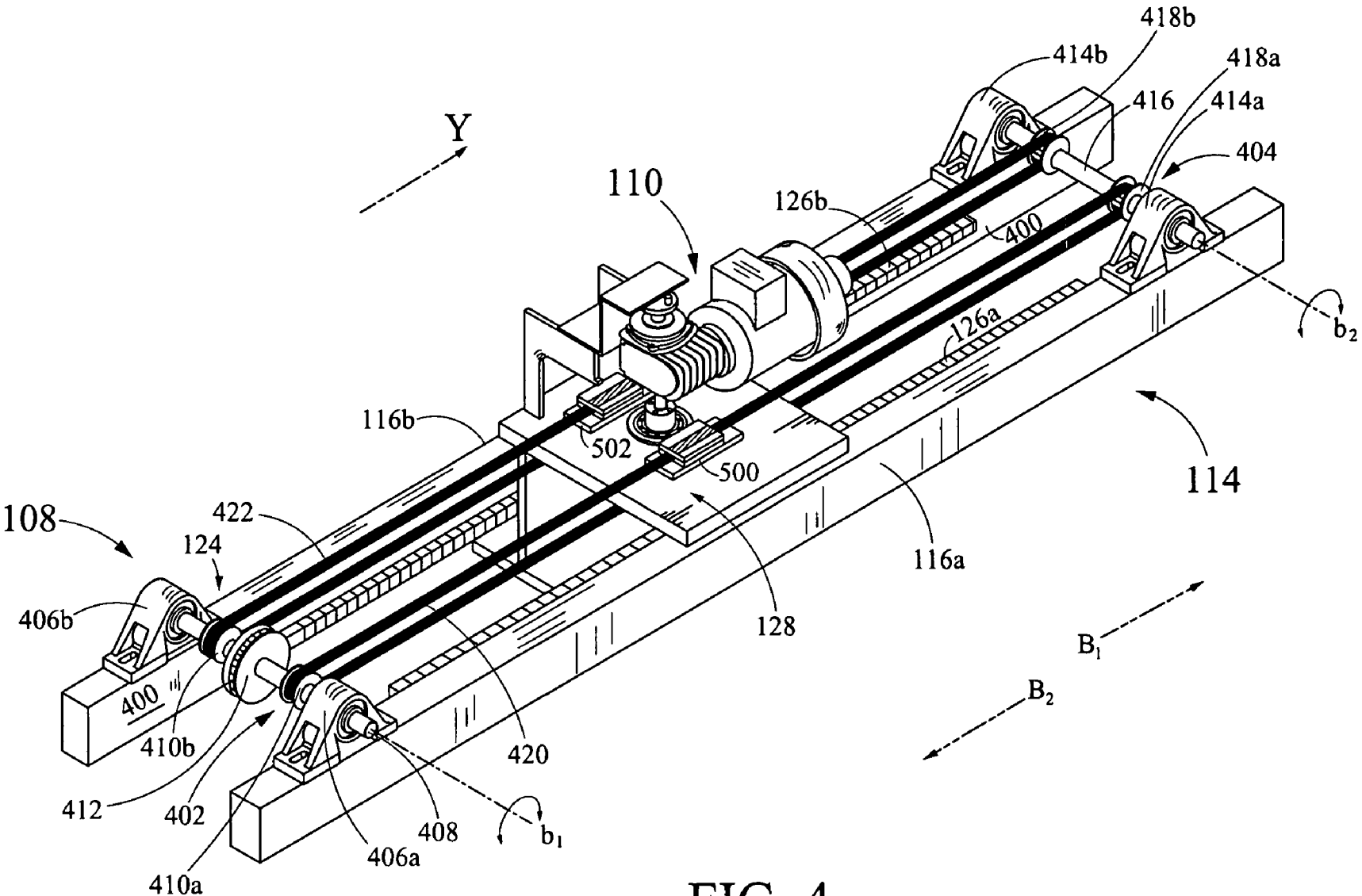
FIG. 4 illustrates a partial perspective view of the training apparatus for depicting a second frame member including a second driving mechanism, in accordance with an exemplary embodiment of the present invention.

Referring to FIG. 4, illustrated is a partial perspective view of the training apparatus 100 for depicting the second frame member 116 including the second driving mechanism 108, in accordance with an exemplary embodiment of the present invention. The second frame member 116 is movably securing the drifting mechanism 110 thereto with the help of the second driving mechanism 108. More specifically, the drifting mechanism 110 is supported on the second driving mechanism 108 configured between the pair of second frame structures 116*a* and 116*b* of the second frame member 116. The second driving mechanism 108 is adapted to be moved along the pair of second frame structures 116*a* and 116*b* of the second frame member 116. The second driving mechanism 108 includes the second pulley assembly 124, the pair of second frame rail assembly 126*a* and 126*b* and the second frame plate assembly 128. The second frame rail assembly 126*a* is coupled to an inner side wall (not shown) of the second frame structures 116*a*. Similarly, the second frame rail assembly 126*b* is coupled to an inner side wall 400 of the second frame structures 116*b*. The pair of second frame rail assembly 126*a* and 126*b* has a structural configuration similar to the structural configuration of the first frame rail assembly 120*b*. Accordingly, a detailed description of the structural configuration of the pair of second frame rail assembly 126*a* and 126*b* has been avoided for sake of brevity.

The second frame plate assembly 128 is disposed between the pair of second frame structures 116*a* and 116*b* and is movably coupled to the pair of second frame rail assembly 126*a* and 126*b*, coupled to the pair of second frame structures 116*a* and 116*b*. The coupling between the second frame plate assembly 128 and the pair of second frame rail assembly 126*a* and 126*b* will be explained in detail in conjunction with FIGS. 5A and 5B. The second frame plate assembly 128 is adapted to support the drifting mechanism 110 thereon, which will be explained in conjunction with FIG. 6. Moreover, the second frame plate assembly 128 is adapted to move along the pair of second frame rail assembly 126*a* and 126*b* with the help of the second pulley assembly 124.

The second pulley assembly 124 includes pulley arrangements 402 and 404 configured at opposite end portions of the second frame member 116. In an embodiment of the present invention, the pulley arrangements 402 and 404 may be configured at opposite end portions of the pair of second frame structures 116*a* and 116*b* and adjacent to the pair of plate assemblies 122*a* and 122*b*, coupled at the opposite end portions. The pulley arrangement 402 includes bearing housings 406*a* and 406*b*, and a rotating shaft 408. The rotating shaft 408 extends between the bearing housings 406*a* and 406*b* and is movably coupled thereto to rotate about an axis $b_1$ thereof. The rotating shaft 408 includes minor pulleys 410*a* and 410*b* coaxially received thereon. The rotating shaft 408 further includes a major pulley 412 received on the rotating shaft 408 and between the minor pulleys 410*a* and 410*b*. The major pulley 412 is adapted to be rotated about the axis $b_1$ of the rotating shaft 408 with the help of a separate belt-motor assembly (not shown).

Similarly, the pulley arrangement 404 includes bearing housings 414*a* and 414*b*, and a rotating shaft 416. The rotating shaft 416 extends between the bearing housings 414*a* and 414*b* and is movably coupled thereto to rotate about an axis $b_2$ thereof. The rotating shaft 416 further includes minor pulleys 418*a* and 418*b* coaxially received thereon.

The pulley arrangements 402 and 404 are operatively coupled to each other with the help of belts 420 and 422 therebetween. More specifically, the belt 420 extends between the minor pulleys 410*a* and 418*a*. In an embodiment of the present invention, the minor pulleys 410*a* and 418*a* are configured to have a grooved peripheral surface adapted to receive the belt 420 thereon. The grooved peripheral surface has sufficient friction to avoid slippage of the belt 420 therefrom. Similarly, the belt 422 extends between the minor pulleys 410*b* and 418*b*. The minor pulleys 410*b* and 418*b* may also be configured to have a grooved peripheral surface, similar to that of the minor pulleys 410*a* and 418*a*, adapted to receive the belt 422 thereon for avoiding slippage therebetween.

A portion of the belts 420 and 422 are coupled to the second frame plate assembly 128. More specifically, a portion (shown with dotted lines in FIG. 4) of the belt 420 is received in an attachment block 500 of the second frame plate assembly 128. Similarly, a portion (shown with dotted lines in FIG. 4) of the belt 422 is received in an attachment block 502 of the second frame plate assembly 128. Accordingly, the plate assembly 128 is adapted to be firmly coupled to the belts 420 and 422.

In operation, the major pulley 412 is rotated by the belt-motor assembly, with the rotation of the major pulley 412, the minor pulleys 410*a* and 410*b* received on the rotating shaft 408, begin to rotate about the axis '$b_1$' of the rotating shaft 408. As a result, the belts 420 and 422 transfer the rotary motion thereof to the minor pulleys 418*a* and 418*b*, which in turn rotate about the axis '$b_2$' of the rotating shaft 416. Accordingly, the belt 420 moves rectilinearly between the minor pulleys 410*a* and 418*a* and the belt 422 moves rectilinearly between the minor pulleys 410*b* and 418*b*.

Upon rectilinear movement of the belts 420 and 422, the second frame plate assembly 128 attached to the portion of the belt 420 and to the portion of the belt 422, moves along the pair of second frame rail assembly 126*a* and 126*b* in the transverse direction 'Y' of the frame assembly 104. The major pulley 412 may be adapted to be rotated in a clockwise and an anticlockwise direction such that the second frame plate assembly 128 may be moved in a forward direction (shown by an arrow '$B_1$') and a backward direction (shown by an arrow 'B2') along the transverse direction 'Y' of the frame assembly 104. Due to such movement of the second frame plate assembly 128, the drifting mechanism 110, supported thereon, moves along pair of second frame rail assembly 126*a* and 126*b* in the transverse direction 'Y' of the frame assembly 104. Accordingly, the dummy 102, operatively coupled to the drifting mechanism 110, may be moved in the transverse direction 'Y' of the frame assembly 104.

Figure 5A:
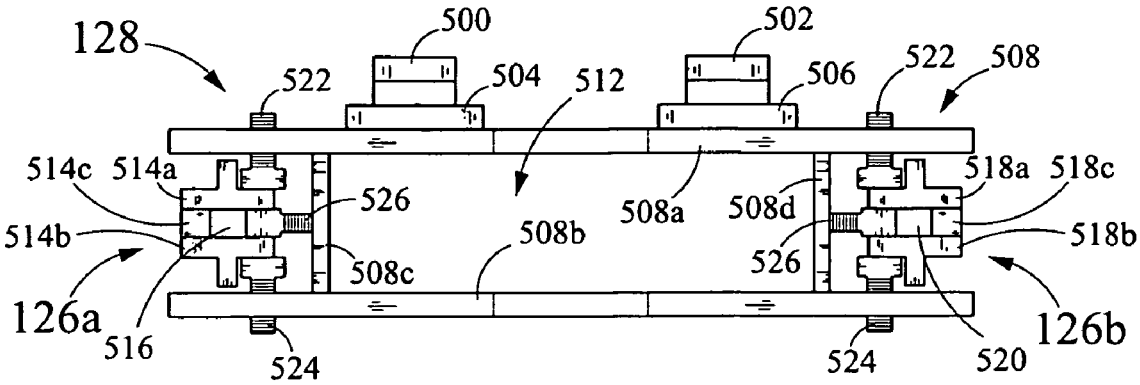
FIGS. 5A and 5B, respectively illustrates an assembled front view and an exploded front view of a second frame plate assembly of the second driving mechanism, in accordance with an exemplary embodiment of the present invention.
Figure 5B:
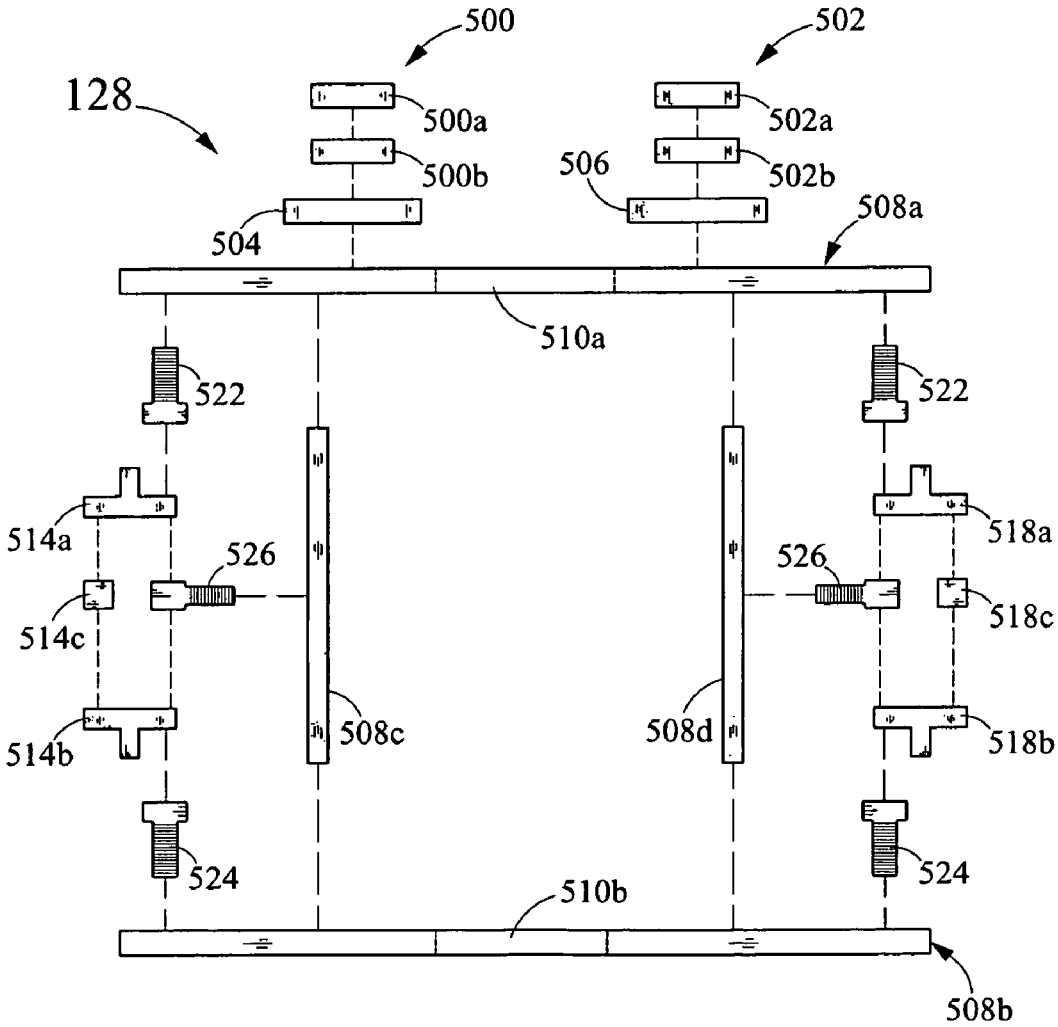

Referring now to FIGS. 5A and 5B, the coupling between the second frame plate assembly 128 and the pair of second frame rail assembly 126*a* and 126*b* is illustrated and described. FIG. 5A illustrates a front view of the second frame plate assembly 128 coupled to the pair of second frame rail assembly 126*a* and 126*b*. Further, FIG. 5B illustrates an exploded front view of the second frame plate assembly 128 and the pair of second frame rail assembly 126*a* and 126*b*.

As shown in FIG. 5A, the second frame plate assembly 128 includes the attachment blocks 500 and 502, support structures 504 and 506, and a housing 508. The attachment blocks 500 and 502 are coupled to the housing 508 with the help of support structures 504 and 506 respectively. However, it will be evident to a person skilled in the art that the attachment blocks 500 and 502 may be directly coupled to the housing 508 and may not require the support structures 504 and 506. The purpose of the attachment blocks 500 and 502 is similar to the attachment block 300, as explained in conjunction with FIGS. 2, 3A and 3B. More specifically, the attachment block 500 includes metal plates 500*a* and 500*b* disposed one over the other in a stacked fashion. The metal plates 500*a* and 500*b* are removably coupled to each other in a manner such that they are adapted to receive the portion of the belt 420 (shown in FIG. 4) therebetween. Similarly, the attachment block 502 includes metal plates 502*a* and 502*b* removably coupled to each other to receive the portion of the belt 422 (shown in FIG. 4) therebetween. The attachment blocks 500 and 502 are secured on the housing 508 in a manner such that the attachment blocks 500 and 502 are spaced apart by a predetermined distance. The space between the attachment blocks 500 and 502 is utilized to accommodate the drifting mechanism 110 therebetween, as shown in FIG. 4.

Further, the housing 508 is configured by coupling a plurality of metal plates, such as horizontal metal plates 508*a* and 508*b*, and vertical metal plates 508*c* and 508*d*. The horizontal metal plates 508*a* and 508*b* include cavities 510*a* and 510*b* configured on a substantially central portion thereof, respectively. More specifically, the cavities 510*a* and 510*b* extend along the thickness of the horizontal metal plates 508*a* and 508*b*. The horizontal metal plates 508*a* is adapted to couple the attachment blocks 500 and 502 thereon in a manner such that the horizontal cavity 510*a* positioned therebetween. The horizontal metal plates 508*a* and 508*b* are spaced apart and coupled to each other with the help of the vertical metal plates 508*c* and 508*d* disposed therebetween, as shown in FIGS. 5A and 5B. More specifically, the horizontal metal plates 508*a* and 508*b* are arranged such that the cavities 510*a* and 510*b* are coaxially disposed over each other. Moreover, the horizontal metal plates 508*a* and 508*b* and the vertical metal plates 508*c* and 508*d* are coupled in a manner to configure a hollow enclosure 512 therebetween. The cavities 510*a* and 510*b* and the hollow enclosure 512 are adapted to receive a portion of the drifting mechanism 110 therein, which will be explained in conjunction with FIG. 6.

The housing 508 is adapted to be disposed between the pair of second frame structures 116*a* and 116*b* of the second frame member 116. More specifically, the housing 508 is movably coupled to the pair of second frame rail assembly 126*a* and 126*b* and thereby movably coupling the second frame plate assembly 128 to the second frame member 116. The second frame rail assembly 126*a* includes second frame rail members 514*a* and 514*b*. In an embodiment of the present invention, the second frame rail members 514*a* and 514*b* may be longitudinal T-shaped bars. The second frame rail members 514*a* and 514*b* may be coupled together by a horizontal bar 514*c* disposed therebetween to configure a longitudinal channel structure 516 therebetween. Similarly, the second frame rail assembly 126*b* includes second frame rail members 518*a* and 518*b*. The second frame rail members 518*a* and 518*b* may have a structural configuration similar to that of the second frame rail members 514*a* and 514*b*. Further, the second frame rail members 518*a* and 518*b* may be coupled together by a horizontal bar 518*c* disposed therebetween to configure a longitudinal channel structure 520 therebetween.

The movable coupling between the second frame plate assembly 128 and the pair of second frame rail assembly 126*a* and 126*b* is enabled by a plurality of metal plugs, such as metal plugs 522, metal plugs 524 and metal plugs 526. The plurality of metal plugs is configured to have structural configuration similar to that of the plurality of metal plugs explained in conjunction with FIGS. 3A and 3B. More specifically, the plurality of metal plugs are configured to have cylindrical head portions, which are adapted to be received on the pair of second frame rail assembly 126*a* and 126*b*.

As shown in FIGS. 5A and 5B, the metal plugs 522 are configured at opposite edge portions of the horizontal metal plate 508*a*. The metal plugs 522 extend downwardly from the horizontal metal plate 508*a* in a manner such that the cylindrical head portions of the metal plugs 522 is received on the second frame rail members 514*a* and 518*a*. Similarly, the metal plugs 524 are configured at opposite edge portions of the horizontal metal plate 508*b*. The metal plugs 524 extend upwardly from the horizontal metal plate 508*b* in a manner such that the cylindrical head portions of the metal plugs 524 are received on the second frame rail members 514*b* and 518*b*. Moreover, the metal plugs 526 are configured on the vertical metal plates 508*c* and 508*d*. More specifically, the metal plugs 526 extend outwardly from the vertical metal plates 508*c* and 508*d* in a manner such that the cylindrical head portions of the metal plugs 526 are received in the longitudinal channel structures 516 and 520, respectively. The plurality of metal plugs are configured at the horizontal metal plates 508*a* and 508*b*, and the vertical metal plates 508*c* and 508*d* in a manner such that the plurality of metal plugs are free to rotate about an axis thereof.

In operation, with the movement of the belt 420 between the minor pulleys 410*a* and 418*a* and the movement of the belt 422 between the minor pulleys 410*b* and 418*b*, the second frame plate assembly 128 begins to move along the pair of second frame rail assembly 126*a* and 126*b*. As a result, the plurality of metal plugs is enabled to rotate about their axis on the respective portions of the pair of second frame rail assembly 126*a* and 126*b* whereupon they are received. The rotational movement of the plurality of metal plugs smoothens the movement of the second frame plate assembly 128 along the pair of second frame rail assembly 126*a* and 126*b*.

Figure 6:
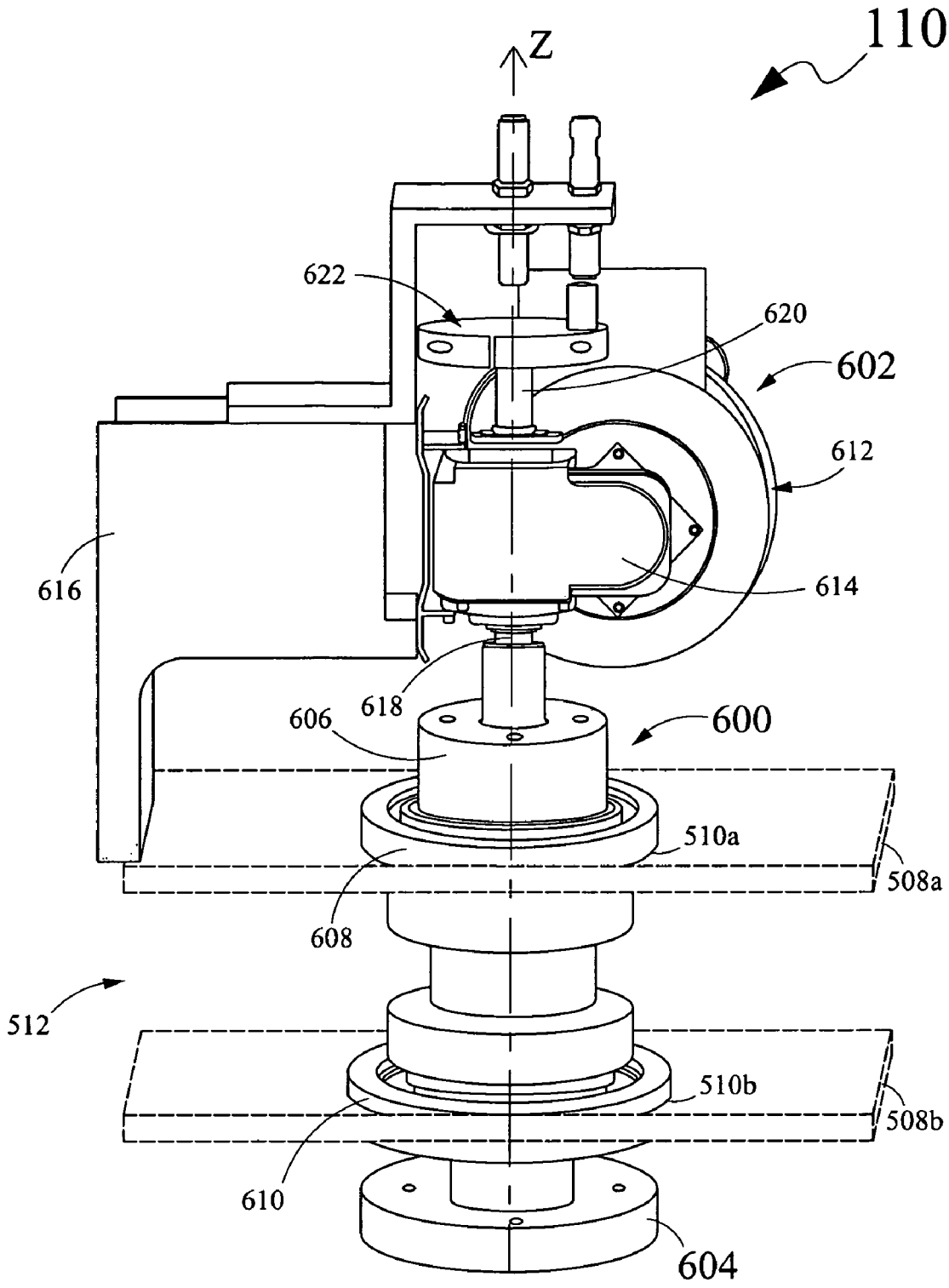
FIG. 6 illustrates a perspective view of a drifting mechanism of the training apparatus, in accordance with an exemplary embodiment of the present invention.

Referring to FIG. 6, illustrated is a perspective view of the drifting mechanism 110 of the training apparatus 100, in accordance with an exemplary embodiment of the present invention. The drifting mechanism 110 includes an engaging member 600, a driving member 602 and an attaching member 604. The engaging member 600 is received in the hollow enclosure 512 through the cavities 510*a* and 510*b* of horizontal metal plates 508*a* and 508*b*, see FIG. 5B. The horizontal metal plates 508*a* and 508*b* of the second frame plate assembly 128 are shown with a dotted line in FIG. 6, for enabling a better depiction of engagement between the engaging member 600 and the second frame plate assembly 128.

The engaging member 600 is adapted to rotate about the vertical axis 'Z' of the frame assembly 104, as shown on FIG. 6. Further, the engaging member 600 includes a cylindrical member 606 that extends downwardly from the cavity 510*a* to the cavity 510*b*. More specifically, the cylindrical member 606 is snugly fitted to the cavities 510*a* and 510*b* through bearing assemblies 608 and 610, respectively. The bearing assemblies 608 and 610 enable the engaging member 600 to smoothly rotate about the cavities 510*a* and 510*b*.

The engaging member 600 is adapted to be rotated by the driving member 602. More specifically the driving member 602 is coupled to the cylindrical member 606 of the engaging member 600 for providing rotational motion thereto. The driving member 602 includes a driving motor 612 and motion conversion assembly 614 operatively coupled to the driving motor 612. The driving motor 612 is horizontally supported on a support bracket 616. The support bracket 616 is supported on the horizontal metal plate 508*a* of the second frame plate assembly 128. In an embodiment of the present invention, the support bracket 616 may be coupled to the horizontal metal plate 508*a* by any conventional coupling method, such as welding, riveting and the like. The motion conversion assembly 614 is adapted to convert a rotational motion of a shaft of the driving motor 612 about a horizontal axis to a rotational motion about a vertical, such as axis 'Z' of the frame assembly 104. It will be evident to a person skilled in the art that motion conversion assembly 614 may include any suitable mechanism known in the art for converting rotational motion about a horizontal axis to a rotational motion about a vertical axis. Further, the motion conversion assembly 614 is coupled to the cylindrical member 606 through a drive shaft 618 extending from the motion conversion assembly 614. The drive shaft 618 is adapted to be rotated about the vertical axis 'Z' upon rotation of the shaft of the driving motor 612 and thereby enabling the cylindrical member 606 to rotate about the vertical axis 'Z'. Accordingly, the engaging member 600 is adapted to be rotated by the driving member 602.

Further, the motion conversion assembly 614 includes a drive shaft 620 extending upwardly therefrom and coupled to a rotary assembly 622. The drive shaft 620 and the rotary assembly 622 are adapted to be rotated about the vertical axis 'Z' upon rotation of the cylindrical member 606.

Referring back to FIG. 6, the attaching member 604 extends downwardly from a bottom portion of the cylindrical member 606. The attaching member 604 is capable of coupling the dummy 102 thereto. In an embodiment of the present invention, the attaching member 604 may include a flanged plate like structure having a suitable arrangement to couple the dummy 102 thereto.

In operation, the dummy 102 coupled to the cylindrical member 606 through the attaching member 604 rotates about the vertical axis 'Z' upon rotation of the cylindrical member 606. The present invention is not limited to the rotational motion of the dummy 102 only. In an embodiment of the present invention, the dummy 102 may be adapted to move pivotally about the vertical axis 'Z'. In another embodiment of the present invention, the dummy 102 may be adapted to move in a vertical direction along the vertical axis 'Z'. The various types of movements of the dummy 102 will be described in conjunction with FIGS. 7A to 7C.

Figure 7C:
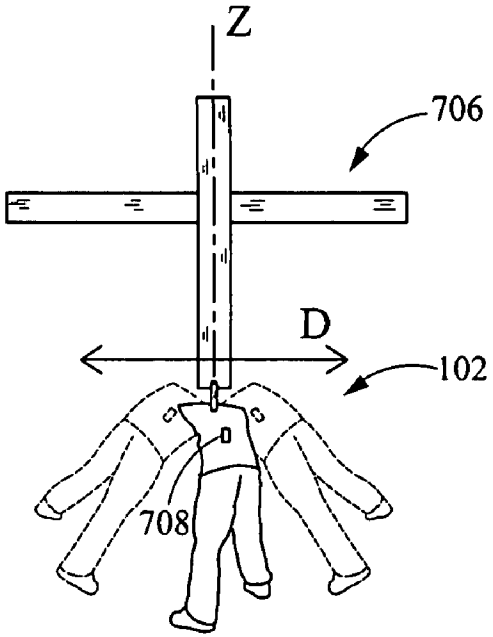
FIGS. 7A through 7C illustrates front views of various attachments of a dummy with the drifting mechanism of the training apparatus, in accordance with an exemplary embodiment of the present invention.
Figure 7B:
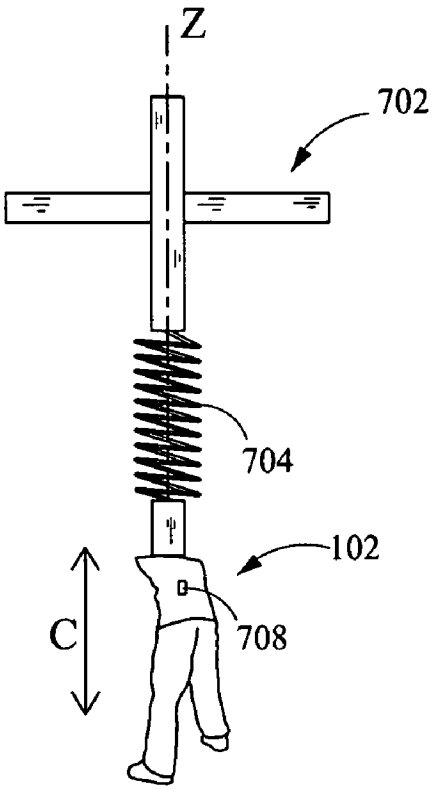
Figure 7A:
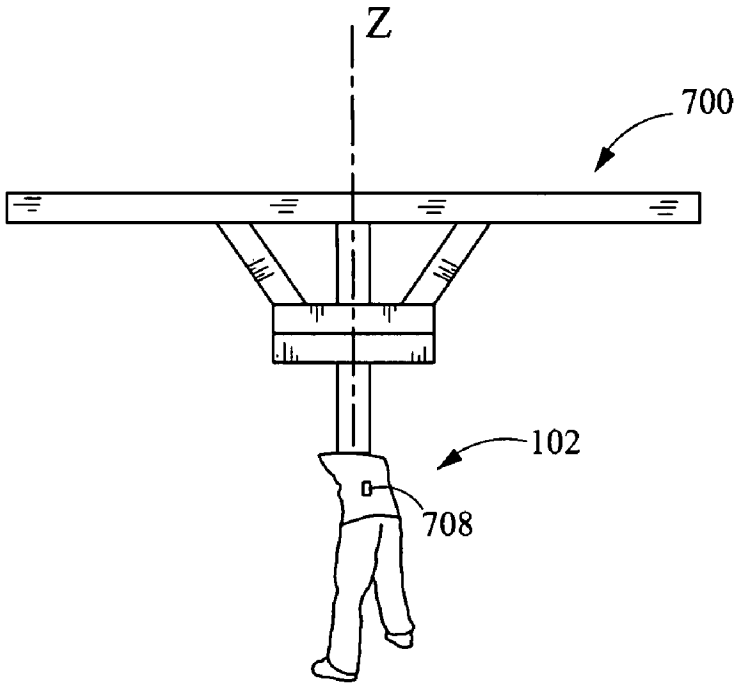

Referring to FIGS. 7A through 7C, illustrated are the front views of various attachments of the dummy 102 with the drifting mechanism 110 of the training apparatus 100, in accordance with an exemplary embodiment of the present invention. In FIGS. 7A to 7C, various coupling arrangements of the dummy 102 with the attaching member 604 is illustrated and described. Particularly, in FIG. 7A, the dummy 102 includes a roller-bearing arrangement 700 for enabling the dummy 102 to be coupled to the attaching member 604. The roller-bearing arrangement 700 is capable of rotating the dummy along the vertical axis 'Z' of the frame assembly 104, as shown in FIG. 7A.

Further, in FIG. 7B, a coupling arrangement 702 adapted to couple the dummy 102 with the attaching member 604 is illustrated. The coupling arrangement 702 is adapted enable the dummy 102 to move in a vertical direction along the vertical axis 'Z'. In an embodiment of the present invention, the coupling arrangement 702 may include a spring arrangement 704. The spring arrangement 704 is capable of moving the dummy 102 in a vertical direction as shown by an arrow 'C', along the vertical axis 'Z' of the frame assembly 104. In another embodiment of the present invention, the coupling arrangement 702 may include a hydraulically operated mechanism that enables the vertical movement of the dummy 102. Moreover, the coupling arrangement 702 may be adapted to lock the dummy 102 at a particular vertical position to simulate actions of real players.

FIG. 7C, illustrates a coupling arrangement 706 for coupling the dummy 102 to the attaching member 604. The coupling arrangement 706 is adapted to enable the dummy 102 to move pivotally as shown by arrow 'D', about the vertical axis 'Z'.

It will be evident to a person skilled in the art that the described coupling arrangements may be combined to configure a single coupling arrangement that enables the dummy 102 to have motion in a multitude of directions.

The dummy 102 may be made from a light weight material and preferably configured to have shape of a human for enabling the players to be trained in simulated real conditions. Further, in an embodiment of the present invention, the dummy 102 may be equipped with at least one sensing element 708 (as shown in FIGS. 7A through 7C). The sensing element 708 may be adapted to sense various movement patterns of players being trained on the training apparatus 100. Further, the sensing elements 708 may be capable of determining and recording reaction time and force of contact of the players, when the players hit the dummy 102 during training.

Furthermore, in another embodiment of the present invention, the dummy 102 may include movable and controllable appendages that simulate the presence and movement of a player's arms. The dummy 102 may also include an actuator that operates by, for example, electromechanical, pneumatic, or hydraulic means for enabling the movement of the appendages.

The various movements of the dummy 102, such as a movements along the longitudinal direction 'X' of the frame assembly 104, along the transverse direction 'Y' of the frame assembly 104 and along the vertical axis 'Z' of the frame assembly 104, as described herein, may be controlled by a control module. More specifically, the training apparatus 100 may be communicably coupled to a control module adapted to control the various movements of the dummy 102 as described above.

Figure 8:
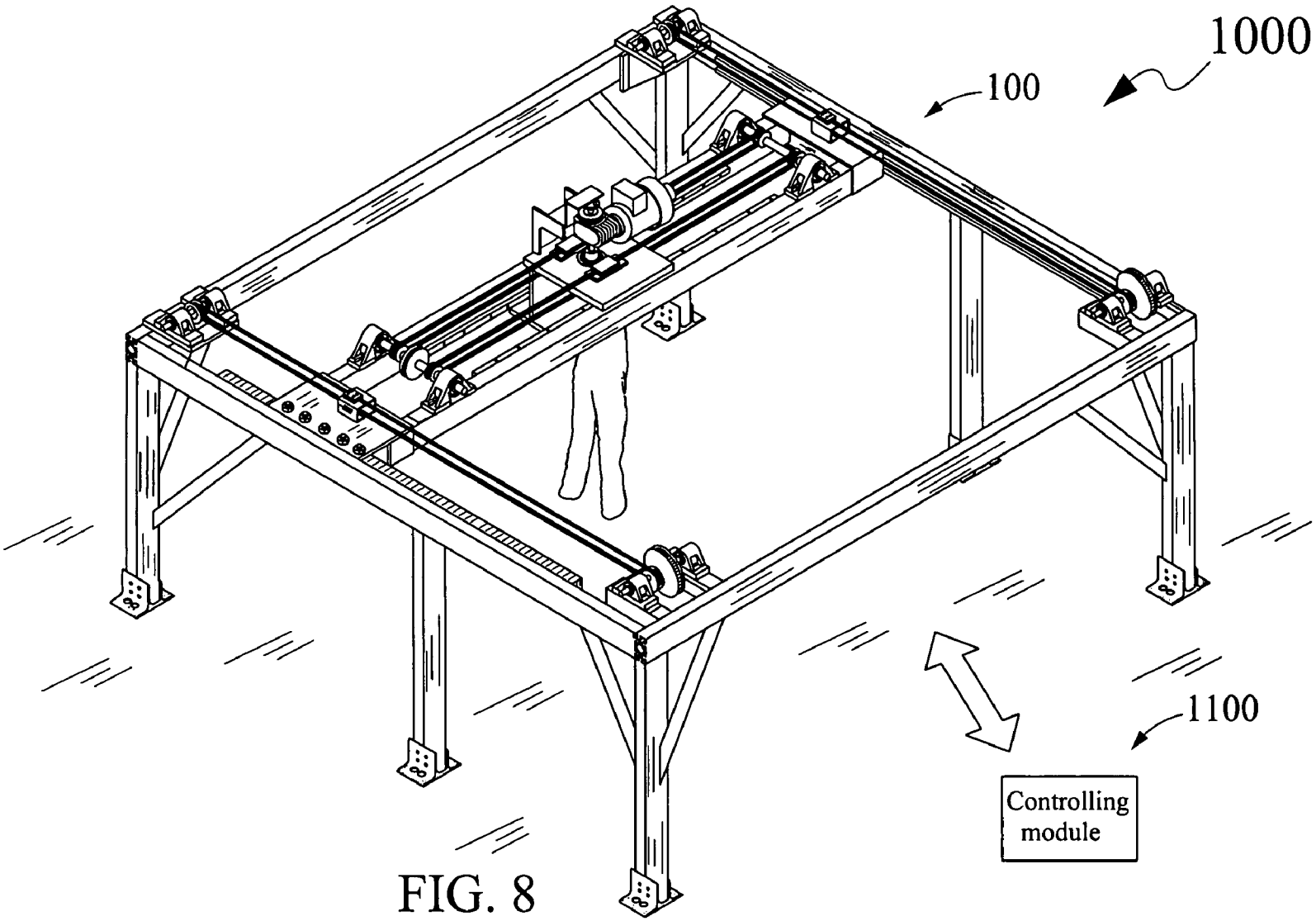
FIG. 8 illustrates a perspective view of a training system, in accordance with an exemplary embodiment of the present invention.

Referring to FIG. 8, illustrated is a perspective view of a training system 1000, in accordance with an exemplary embodiment of the present invention. The training system 1000 includes a training apparatus, such as training apparatus 100, and a controlling module 1100 communicably coupled to the training apparatus 100. The controlling module 1100 may be utilized to move the dummy 102 in a multitude of directions for training players. More specifically, the controlling module 1100 may be utilized to enable the second frame member 116 to move longitudinally along the pair of first frame members 112, thereby moving the dummy 102 in the longitudinal direction 'X' of the frame assembly 104. Further, the controlling module 1100 may also be utilized to enable the drifting mechanism 110 to move along the second frame member 116 for moving the dummy 102 in the transverse direction 'Y' of the frame assembly 104. Moreover, the controlling module 1100 may be utilized to enable the dummy 102 to move in a multitude of directions about the vertical axis 'Z' of the frame assembly 104 as explained in conjunction with FIGS. 7A through 7C. In an embodiment of the present invention, the controlling module 1100 may also be utilized to move the appendages of the dummy 102.

The controlling module 1100 may be communicably coupled to the training apparatus 100 through wired or wireless interface. Accordingly, the controlling module 1100 may be utilized to remotely operate the training apparatus 100. The controlling module 1100 may include at least one human machine-interface (not shown), such as a pedal, a switch, a joystick, a lever, a button, and the like for controlling the movement of the dummy 102. The controlling module 1100 may further include a processing apparatus (not shown) operatively coupled to the human-machine interface. The processing apparatus may be adapted to control the movement of the dummy 102 upon receiving instructions from the human-machine interface. In use, the human-machine interface may be handled by a coach to move the dummy 102 in various directions to simulate real time game conditions for training players.

In an embodiment of the present invention, the controlling module 1100 may also include a touch-screen for plotting a movement pattern of the dummy 102.

The operation of the training system 1000 is explained in conjunction with FIGS. 1 through 7C. As described herein, the dummy 102 is capable of being moved in various directions, such as in the longitudinal direction 'X', the transverse direction 'Y' and the vertical direction 'Z' of the frame assembly 104. The said movements of the dummy 102 may be enabled simultaneously for simulating real time situations of an actual game for training players. Accordingly, the athletic skills of the players may be easily and reliably measured and analyzed. Some of the examples of the athletic skills of football players that may be evaluated by the training apparatus 100 includes:

Rushing: A strategic maneuver used by the defensive side to keep the offensive side from gaining yardage and scoring points. Also, strategic maneuver used by a ball carrier to gain yardage and score points.

Blocking: A strategic maneuver used by the offensive side to keep the defensive side away from a player carrying the ball.

Tackling: A strategic maneuver used by the defensive side to keep an offensive ball carrier from gaining yardage and scoring points.

Pass blocking: A strategic maneuver used by the offensive side to keep the defensive side away from a player passing the ball.

Run blocking: A strategic maneuver used by the defensive side to keep the offensive side away from a player running the ball.

For training the players on said athletic skills, the training system 1000 may be utilized to control the movement of the dummy 102. The movement of the dummy 102 may be initiated in two different ways. Firstly, the sensing element 708 senses the movement of the player being trained on the training system 1000 and moves the dummy 102 accordingly. Secondly, the movement of the dummy 102 may be initiated by the joystick, which is controlled by the coach. Once the movement of the dummy 102 is initiated, the coach may selectively control the movement of the dummy 102 by the controlling module 1100. Accordingly, the dummy 102 may be moved in a various directions for training the players.

For example, if a player is being trained to improve his/her run blocking skills, the player will hit the dummy 102 head-on and continue to drive the dummy 102 backwards. Accordingly, the dummy 102 acts as an imaginary defender and continues to resist the player's movement at predetermined force and in a predetermined direction, which is selected by the coach through the controlling module 1100. More specifically, the directions may be selected by the coach by joystick or by drawing the desired movement patterns for the dummy 102 on the touch screen of the controlling module 1100.

Moreover, the dummy 102 is adapted to strike the player with a strike force having duration of one-hundredth of a second. Thereafter, the dummy 102 resists the player's movement with a constant force. The controlling module 1100 is adapted to enable the coach to change the strike force as desired. Moreover, the controlling module 1100 may be selectively utilized to change the acceleration or the speed of the dummy 102. The strike force, acceleration or speed of the dummy 102 may be controlled in two steps: (1) initially, the strike force between the dummy 102 and the player is fixed by inputting at least one variable including, but not limited to, acceleration, reaction time, maximum speed and force; (2) after the initial strike force, the dummy 102 is configured to apply a driving force by selectively setting the speed, acceleration and force for the striking. The sensing element 708 provided in the dummy senses a condition when a constant force is being applied thereto by the player, and the same is signaled to the controlling module 1100. The coach may thereafter enable the controlling module 1100 to increase or decrease the drive force, in order to simulate and replicate the actual variable force produced by an actual player in an actual game condition.

Accordingly, the training system 1000 may be utilized to simulate real time situations of an actual football game for training the players in an easy and reliable manner. Further, the training system 1000 is not limited to train football players only. The training system 1000 may be advantageously utilized to train players involved in other contact sports, such as ice hockey, lacrosse, amateur wrestling, boxing, kickboxing, All-style Fighting Competition, full-contact karate, mixed martial arts, Thai-boxing, and the like.

The present invention is not limited to the exemplary embodiments as described herein. The present invention can be modified into many alternative embodiments. In an embodiment of the present invention, a training apparatus which include a dummy and a platform. The dummy may be removably attached to a top side of the platform that includes a training area in which a player interacts with the dummy. A bottom side of the platform features a magnetic arrangement and a mechanism for moving the magnetic arrangement within the periphery of the platform. The dummy may be magnetically coupled to the magnetic arrangement such that a controlling module may operate the magnetic arrangement to move the dummy within the periphery of the platform. The magnetic arrangement may enable the dummy to move simultaneously in a multitude of directions about the platform.

In another embodiment of the present invention, the training apparatus may include light and sound transmission devices that enable a user of the training apparatus to selectively direct light and sound transmissions on players as stimuli to measure, for example, the players' reaction times and tolerances to such stimuli. The training apparatus may also include other transmission devices that simulate weather and other environmental conditions, such as wind.

In an embodiment of the present invention, a length of a lateral movement of the dummy is 5 feet from the 'Z' axis on each way, and speed is adjustable with a maximum speed of 15 feet per second by the controlling module. The dummy may also be configured to move laterally without spinning. Further, both the movements of the dummy may locked, to move the dummy in a rectilinear direction about the 'Z' axis, thereby providing the player an opportunity of experiencing the movements as if facing a real player.

Various embodiments of the present invention provide the following advantages. The present invention provides a training apparatus capable of moving a dummy in a multitude of directions simultaneously. The simultaneous movements of the dummy in various directions are capable of simulating real time conditions of an actual football game for training the players. Moreover, the training system, as described herein, is also adapted to measure and analyze athletic skills of the players, without requiring two real football players to compete against each other. Further, the training apparatus may be remotely controlled with the help of a controlling module for training players in an easy and reliable manner.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. A training apparatus, comprising:

a frame assembly comprising a pair of first frame members, the pair of first frame members spaced apart and extending longitudinally opposite to each other, a pair of supporting frame members spaced apart and extending longitudinally opposite to each other, the pair of supporting frame members coupled to the pair of first frame members configuring a space therebetween, and a second frame member operatively coupled to the pair of first frame members and extending therebetween;

a first driving mechanism adapted to configure an operative coupling between the pair of first frame members and the second frame member;

a drifting mechanism movably secured to the second frame member, the drifting mechanism adapted to move longitudinally along the second frame member;

a second driving mechanism adapted to support the drifting mechanism thereon and movably secure the drifting mechanism to the second frame member; and a dummy operatively coupled to the drifting mechanism, the dummy being movably secured to the second frame member through the drifting mechanism, wherein the first driving mechanism is capable of moving the second frame member longitudinally along the pair of first frame members, thereby enabling the dummy to move in a longitudinal direction of the frame assembly, and, wherein the second driving mechanism is capable of moving the drifting mechanism longitudinally along the second frame member, thereby enabling the dummy to move in a transverse direction of the frame assembly, wherein the second frame member comprises a pair of second frame structures spaced apart and extending longitudinally opposite to each other between the pair of first frame members, the pair of second frame structures being operatively coupled to the drifting mechanism through the second driving mechanism, wherein the second driving mechanism comprises: a second pulley assembly configured on opposite end portions of the second frame member; a pair of second frame rail assemblies configured on the pair of second frame structures, the pair of second frame rail assemblies extending along the pair of second frame structures; and a second frame plate assembly movably coupled to the pair of second frame rail assemblies, the second frame plate assembly adapted to longitudinally move along the pair of second frame rail assemblies, wherein the second frame plate assembly is adapted to be coupled to the drifting mechanism for enabling the operative coupling between the drifting mechanism and the second frame member, and, wherein the second pulley assembly is capable of moving the second frame plate assembly longitudinally along the pair of second frame rail assemblies, thereby enabling the drifting mechanism to move longitudinally along the second frame member for moving the dummy in the transverse direction of the frame assembly.

2. The training apparatus of claim 1, wherein the coupling of the pair of first frame members and the pair of supporting frame members configure a substantially rectangular space therebetween.

3. The training apparatus of claim 1, wherein the first driving mechanism comprises:

a pair of first pulley assemblies configured at opposite end portions of the pair of supporting frame members, wherein the pair of first pulley assemblies extends along the pair of first frame members;

a pair of first frame rail assemblies coupled to an inner side walls of the pair of first frame members; and a pair of first frame plate assemblies coupled to opposite end portions of the second frame member, the pair of first frame plate assemblies being operatively coupled to the pair of the first frame rail assemblies to move longitudinally along the pair of first frame rail assemblies, wherein the pair of first pulley assemblies is capable of moving the pair of first frame plate assemblies longitudinally along the pair of first frame rail assemblies for enabling the second frame member to move longitudinally along the pair of first frame members.

4. The training apparatus of claim 1, wherein the frame assembly further comprises a plurality of support members coupled to the frame assembly and extending downwardly therefrom for supporting the frame assembly on a surface.

5. The training apparatus of claim 1, wherein the second pulley assembly is configured on opposite end portions of the pair of second frame structures and the pair of second frame rail assemblies is coupled to inner side walls of the pair of side frame structures.

6. The training apparatus of claim 1, wherein the drifting mechanism comprises:

an engaging member movably coupled to the second frame plate assembly;

an attaching member coupled to an end portion of the engaging member, the attaching member is adapted to removably couple the dummy; and a driving member operatively coupled to another end portion of the engaging member, wherein the driving member is capable of moving the attaching member along a vertical axis of the frame assembly, thereby enabling the dummy to move in a vertical direction of the frame assembly.

7. The training apparatus of claim 6, wherein the dummy is removably coupled to the attaching member by a collar-bearing arrangement.

8. The training apparatus of claim 7, wherein the collar-bearing arrangement is capable of rotating the dummy along the vertical axis of the frame assembly.

9. The training apparatus of claim 6, wherein the dummy is removably coupled to the attaching member by a spring arrangement.

10. The training apparatus of claim 9, wherein the spring arrangement is capable of moving the dummy in a rectilinear direction along the vertical axis of the frame assembly.

11. The training apparatus of claim 6, wherein the dummy is removably coupled to the attaching member by a hydraulic arrangement.

12. The training apparatus of claim 11, wherein the hydraulic arrangement is capable of moving the dummy in a rectilinear direction along the vertical axis of the frame assembly.

13. The training apparatus of claim 6, wherein the dummy is removably coupled to the attaching member by a pivot arrangement.

14. The training apparatus of claim 13, wherein the pivot arrangement is capable of moving the dummy laterally along the vertical axis of the frame assembly.

15. The training apparatus of claim 6, further comprising a controlling mechanism, wherein the controlling mechanism is capable of controlling the movement of the dummy in the longitudinal direction, in the transverse direction, and in the vertical direction of the frame assembly.

16. The training apparatus of claim 15, wherein the controlling mechanism comprises at least one human machine-interface.

17. The training apparatus of claim 16, wherein the at least one human machine-interface is at least one of a pedal, a switch, a joystick, a lever, a button and a knob for controlling the movement of the dummy in the longitudinal direction, in the transverse direction, and in the vertical direction of the frame assembly.

18. The training apparatus of claim 15, wherein the controlling mechanism comprises a touch-screen for drawing a movement pattern thereon to move the dummy in the longitudinal direction, in the transverse direction, and in the vertical direction of the frame assembly.

19. The training apparatus of claim 15, wherein the controlling mechanism comprises a programmable controller for controlling the movement of the dummy in the longitudinal direction, in the transverse direction, and in the vertical direction of the frame assembly.

20. The training apparatus of the claim 1, wherein the dummy comprises at least one sensor for sensing a movement of a player.

21. A training system, comprising:

a training apparatus, the training apparatus comprising a frame assembly, the frame assembly comprising a pair of first frame members, the pair of first frame members spaced apart and extending longitudinally opposite to each other, a pair of supporting frame members spaced apart and extending longitudinally opposite to each other, the pair of supporting frame members coupled to the pair of first frame members configuring a space therebetween, and a second frame member operatively coupled to the pair of first frame members and extending therebetween;

a first driving mechanism adapted to configure an operative coupling between the pair of first frame members and the second frame member;

a drifting mechanism movably secured to the second frame member, the drifting mechanism adapted to move longitudinally along the second frame member;

a second driving mechanism adapted to support the drifting mechanism thereon and movably secure the drifting mechanism to the second frame member; and a dummy operatively coupled to the drifting mechanism, the dummy being movably secured to the second frame member through the drifting mechanism; and a controlling module communicably coupled to the training apparatus, wherein the first driving mechanism is capable of moving the second frame member longitudinally along the pair of first frame members, thereby enabling the dummy to move in a longitudinal direction of the frame assembly, and, wherein the second driving mechanism is capable of moving the drifting mechanism longitudinally along the second frame member, thereby enabling the dummy to move in a transverse direction of the frame assembly, and, wherein the drifting mechanism drives the dummy along a vertical axis thereof, thereby enabling the dummy to move along a vertical axis of the frame assembly, and, wherein the controlling module is capable of controlling the longitudinal direction movement, the transverse direction movement, and the vertical axis movement of the dummy.

* * * * *